United States Patent [19]

Miller

[11] Patent Number: 4,560,162

[45] Date of Patent: Dec. 24, 1985

[54] ADJUSTABLE GRIP FOR BOWLING BALL

[76] Inventor: Peter J. Miller, 24 Tristan Cir., Sacramento, Calif. 95823

[21] Appl. No.: 684,108

[22] Filed: Dec. 20, 1984

[51] Int. Cl.[4] ..... A63B 37/00

[52] U.S. Cl. ..... 273/63 B

[58] Field of Search ..... 273/63 R, 63 A, 63 B, 273/63 E

[56] References Cited

U.S. PATENT DOCUMENTS

| | | | |
|---|---|---|---|
| 2,435,327 | 2/1948 | Seurynck | 273/63 B |
| 2,436,976 | 3/1948 | Seurynck | 273/63 B |
| 2,842,367 | 7/1958 | Keith | 273/63 B |
| 3,012,783 | 12/1961 | Bunk et al. | 273/63 B |
| 3,416,796 | 12/1968 | Ginder | 273/63 B |

*Primary Examiner*—George J. Marlo

*Attorney, Agent, or Firm*—Mark C. Jacobs

[57] ABSTRACT

A device mountable within the thumb opening or thumb hole of a bowling ball which is manually adjustable to constrict the opening i.e., narrow the diameter of the opening of the thumb hole. A screw is threaded directly against a movable shoulder which narrows the opening for the thumb. Unscrewing or reversal of the screw causes the shoulder to move outwardly toward its orginal position to enlarge the opening for the thumb. The screw includes a bottom lip to prevent it from being totally unscrewed and the possible risk of loss.

In a second embodiment, a screw serves as a cam rotator to move a cam on an eccentric toward the movable shoulder thereby forcing the shoulder to move inwardly and thus constrict the thumb opening.

6 Claims, 13 Drawing Figures

ADJUSTABLE GRIP FOR BOWLING BALL

BACKGROUND OF THE INVENTION

It is well known that parts of the human body is subject to change in size according to the weather. That is the fingers swell in summer when subjected to heat and humidity such that rings that fit in the winter are tight fitting in the hot summer.

Just as fingers swell, so does the thumb. When a tournament bowler bowls over extended periods of time, the thumb can swell due to the influences of heat, perspiration, and even callouses. Since tournament bowlers be they amateur or professional have their own ball(s) which have been drilled to their finger and thumb dimensions, they are subject to discomfort should the thumb size change upwardly, i.e. become bigger in cross-section.

On the other hand, compensation by drilling the thumb hole wider in cross-section only causes problems during periods of standard dimension, i.e. the beginning of a tournament, cool weather etc.

While thumb inserts are known, for permanently reducing the diameter of the thumb hole, there has never been an adjustable thumb hole adapter which can be opened outwardly to enlarge the diameter of the thumb opening for adjustment during times of stress, i.e. thumb enlargement.

Typical of the prior art known by Applicant is U.S. Pat. No. 3,416,796 issue to Ginder. This patent discloses a cylindrical longitudinally-slotted finger-receiving insert which is axially movable within a cylindrical sleeve secured within the bowling ball's finger or thumb opening. A securing bolt that passes through a closure member at one end of the insert axially moves the tapered walls of the insert and sleeve to co-act to change the interior diameter of the insert without changing the angular relationship between the insert and the longitudinal axis. The device is quite complex in order to maintain a cylindrical balance within the finger or thumb opening as desired by the inventor thereof.

There is a need therefore for a simple thumb or finger receiving insert for a bowling ball which can be enlarged at will for use in bowling balls.

It is an object therefore of this invention to provide a device which can be mounted within a predrilled thumb bore of a bowling ball and which is manually adjustable to alter the diameter of the thumb opening.

It is another object to provide a device to narrow the thumb or finger opening in a bowling ball from the surface of the ball.

It is another object to provide a device to narrow the thumb opening in a bowling ball from within the thumb hole cylinder.

It is yet another object to provide a thumb hole insert that is within the guide lines of the American bowling Congress both as to weight and materials.

Other objects of the invention will in part be obvious and will in part appear hereinafter.

The invention accordingly comprises the apparatus possessing the construction, combination of elements and the arrangement of parts which are exemplified in the following detailed disclosure, and the scope of which will be indicated in the claims.

SUMMARY OF THE INVENTION

A device mountable within the thumb opening or thumb hole of a bowling ball which is manually adjustable to constrict the opening i.e., narrow the diameter of the opening of the thumb hole. A screw is threaded directly against a movable shoulder which narrows the opening for the thumb. Unscrewing or reversal of the screw causes the shoulder to move outwardly toward its original position to enlarge the opening for the thumb. The screw includes a bottom lip to prevent it from being totally unscrewed and the possible risk of loss.

In a second embodiment, a screw serves as a cam rotator to move a cam on an eccentric toward the movable shoulder thereby forcing the shoulder to move inwardly and thus constrict the thumb opening.

DESCRIPTION OF THE PREFERRED EMBODIMENT

Figure 2:
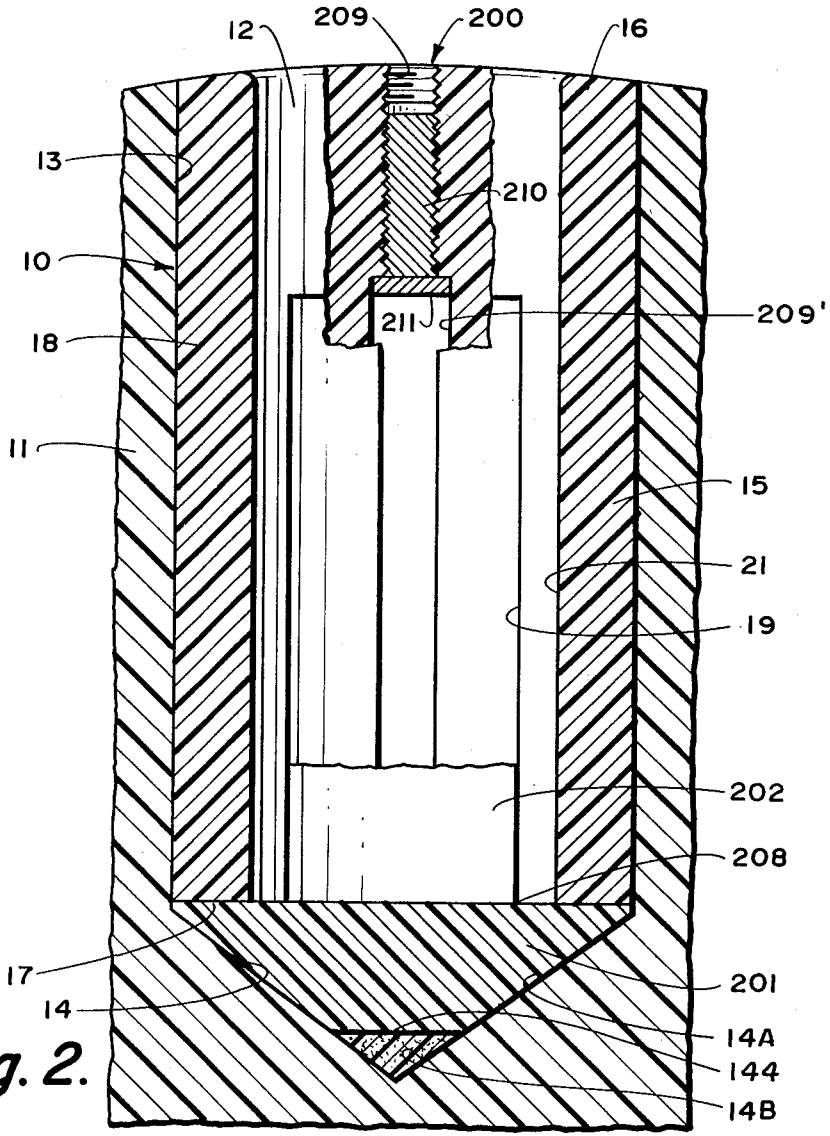
FIG. 2 is an elevational view taken along line 2—2 my FIG. 1.
Figure 6:
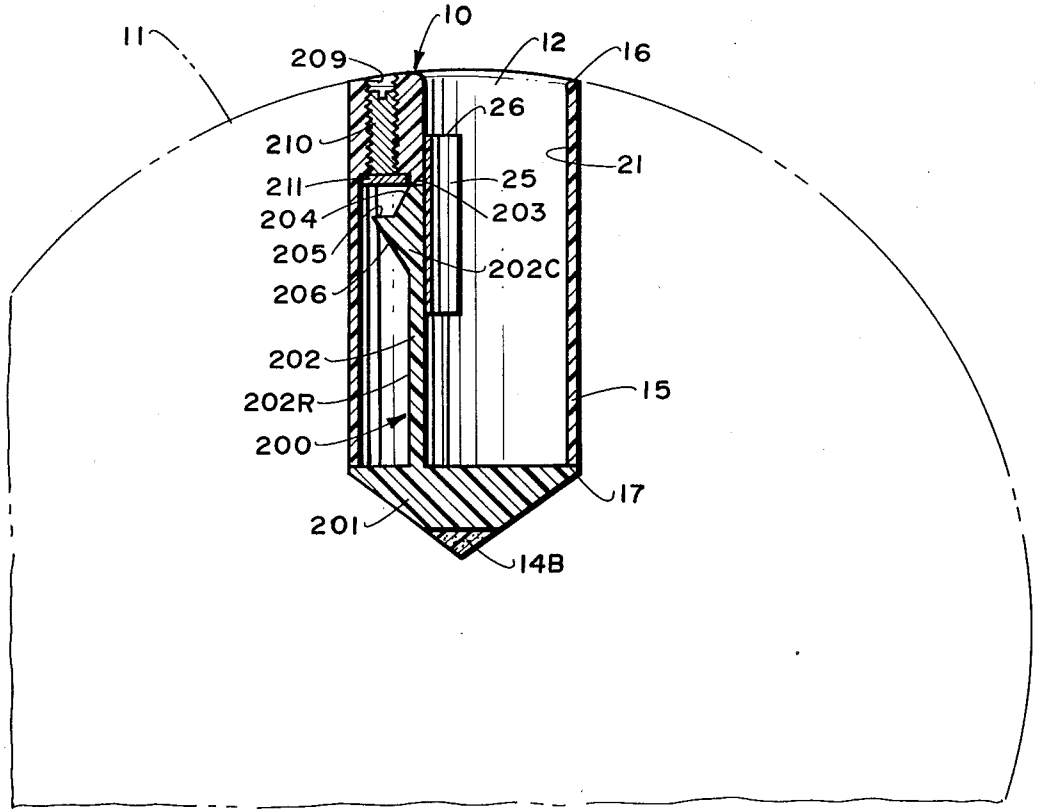
FIG. 6 is a cutaway view of a bowling ball showing the device of FIG. 1 disposed therein.

In FIG. 2 we see a sectional view of device 10 disposed within a bowling ball 11's thumb hole or thumb opening 13, which opening is also seen in FIG. 6. Device 10 is sized in outside dimension across its diameter to be about 1.5 inches across, which is the general size of the thumb opening of a 16–18 pound bowling ball as used by adult men. The space where the thumb would have fit but for the use of the instant device is designated the thumb hole. The instant device also includes a space for the thumb and that is designated thumb opening 12.

Figure 1:
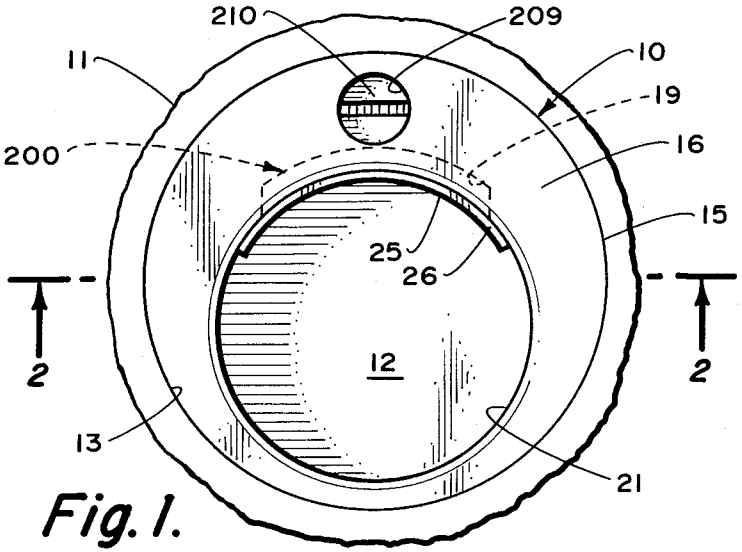
FIG. 1 is a top plan view of the first embodiment of the instant device.

Since the original thumb hole may or may not be of proper diamter to receive the instant device 10, it may be necessary to widen the hole 13, as well as to deepen same to receive a portion of the movable member 201 as will be described below. Thus when enlarged depth wise and perhaps width wise as well, the thumb hole 13 also includes a countersunk portion 14 formed of an upper area 14A and a lower arm 14B, the latter to be discussed later herein. When redrilling a thumb hole, care must be taken to redrill the hole off centre, since the thumb opening of the instant device is off centre. This allows the user to maintain the same finger span when the device is inserted into the redrilled thumb opening. Reference is made to FIG. 1 for instance.

While the preexisting thumb hole can be widened and/or drilled deeper to receive the instant device, more often it is preferable to redrill the hole which will receive the instant device. More often than not, the instant devices are to be utilized in the thumb hole. In order to maintain correct (unaltered) finger span, it is often beneficial to plug one or more of the holes and then redrill them at other locations when utilizing the device of this invention. This is especially true when the instant device is to be used in the thumb hole.

Device 10 is fixedly secured within the bowling ball 11 by drilling a bore to deepen and widen in the thumb hole 13, to sufficient diameter to receive device 10. If the original thumb hole 13 is of adequate diameter only portion 14 will need be drilled. Portion 14B arises due to the fact that drill bits are pointed. Since portion 14B of bore 14 is unneeded it is filled with an epoxy or other suitable caulk-filler material. Countersunk portion 14A is adapted to receive base 201 therein. A suitable adhesive is applied to the external surface of cylinder 15 to cement it to the wall of the thumb opening 13, prepared as described above.

As will be seen from a description of the parts and components to follow, movement of the movable member 200's vertical section 201 adjusts the diameter of the device 10's thumb opening, when the camming screw 310 is turned, i.e. the object of the device.

Having described how to secure the device and having given a brief overview thereof, let us move forward with a description of the several components of device 10.

Figure 4:
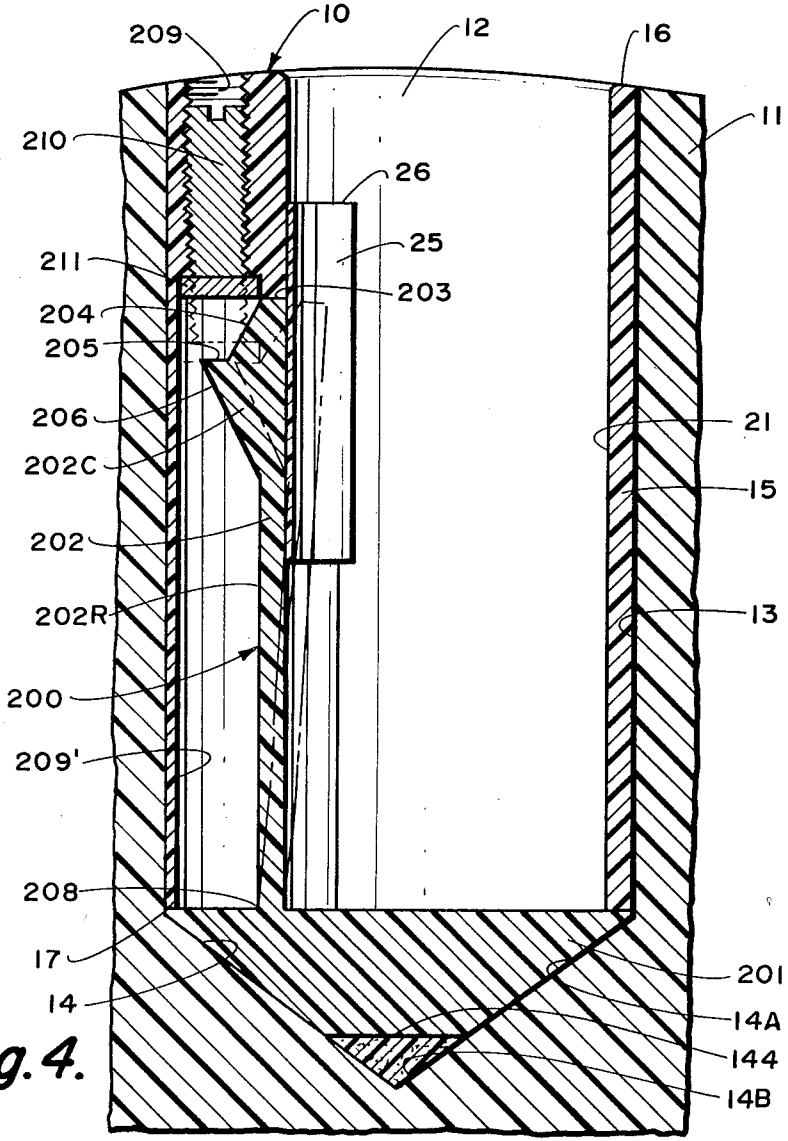
FIG. 4 is an elevational view of a portion of this invention.

As shown, device 10 includes an outer cylinder 15, an eccentricly disposed through bore 12 which serves as a finger opening, a top wall 16, and a base 17, which base includes an upward extending recess 21 into which is disposed movable member 200, shown in its entirety in FIG. 4. For ease of understanding a portion of movable member 200 is shown in FIG. 2 as well. Designator 18 indicates the wall thickness of outer cylinder 15, which thickness can vary since the new thumb opening 12 is off center from and not concentric with the diameter of top wall 16. Reference is made to FIG. 1. However, in view of the mode of insertion of device 10 into original thumb hole 13 as discussed above, the underside view as per FIG. 7 does look concentric. In fact however, what is concentric is only the top surface of the filler material 144.

Outer cylinder 15 includes a depressed recess 19 that commences approximately ¾ths of an inch down from top wall 16, which recess is arcuate in shape and runs from its point of commencement to the very bottom of the outer cylindrical member 15. This recess extends inwardly from the proximal side of the eccentrically disposed finger opening 12. For the sake of reference, the distal side of the finger opening is the narrow area where the two circles of FIG. 1 are closest together. It is within the arcuate confines of this recess, that the vertical section 202 of the moving member 200 is to be disposed.

Figure 5:
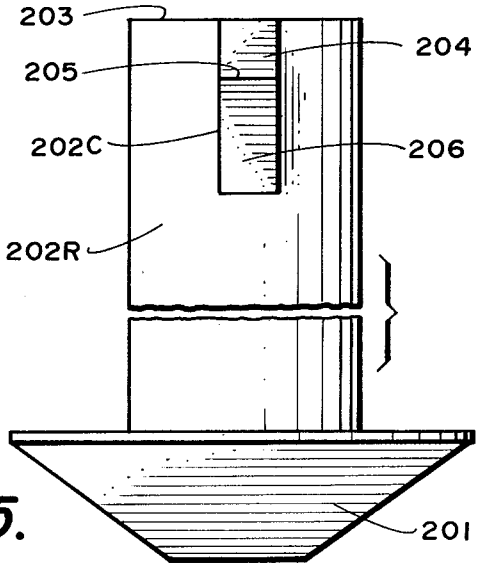
FIG. 5 is an elevational view of the portion of the device shown in FIG. 4, but taken along line 5—5 of FIG. 4.

Turning now to FIG. 4, wherein the movable member 200 is shown. It comprises a base 201, upon which is mounted an elongated vertical section 202. The base 201 is configured as an inverted truncated cone. The vertical section front face is arcuate in configuration horizontally and conforms to the curvature of the recess 19. The rear surface 202R is also arcuate as can be seen in FIG. 1, but it also includes a camming member 202C mounted on the rear side 202R of 202. The camming member commences at the rear of top surface 203 of vertical member 202, depends downwardly and outwardly toward cylinder 15 to horizontal surface 205 and then depends downwardly and rearwardly along surface 206 to curved rear surface 202R. See also FIG. 5.

When the movable member 202 is flexed by movement of the camming screw 210, as will be described below, it flexes from its point of connection to base 201, which point is designated 208. While shown affixed by a butted connection as by molding or adhesing, it is within the scope of the invention to include a slot, not shown but located at 208, into which the vertical section would be either friction fit or adhesed.

The camming screw 210 is adapted to be threadedly engaged by threaded bore 209 of cylinder wall 18. Camming screw 210 which is in essence a set screw, also includes a non-threaded shoulder 211 of greater cross section than the screw itself. Thus when inserted from the under side of threaded bore 209, up through the unthreaded elongated bore 209, the set screw 210 cannot be inadvertently removed by excess turns of the screw driver to be lost. Bore 209 is adjacent to and communicates with said recess. See FIG. 3.

The same thought has gone into preventing the movable member 200's vertical section 202 from coming out the top through thumb opening 12. By having the base 201 equal to the diameter of the outer cylinder, once the outer cylinder 15 is inserted into the thumb hole 13, the base 201 cannot be removed. Thus the only motion that the vertical section 202 can undergo is the flex inwardly along connection line 208 upon the receipt of pressure from the camming screw's shoulder 211 upon slanted surface 204.

Figure 3:
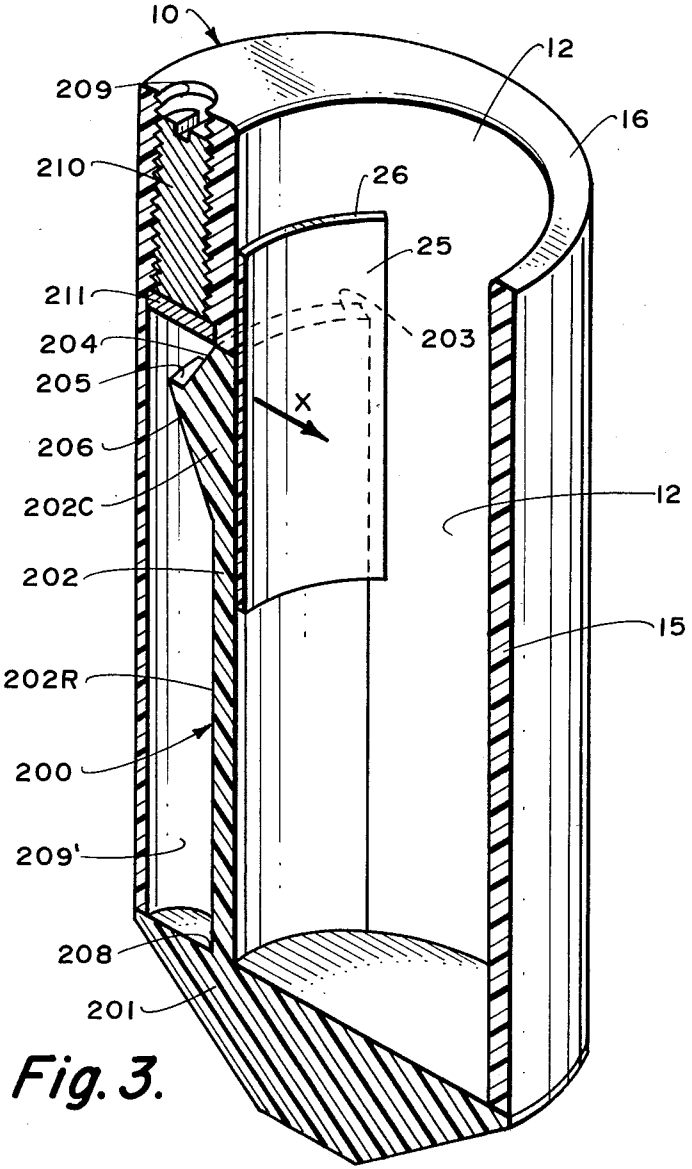
FIG. 3 is a cut away perspective view of the first embodiment.

In order to constrict the opening 12 within device 10, a screw driver, not seen is applied to the head of the set screw 210. When threaded in its normal clockwise direction, it moves downwardly causing the shoulder 211 to impinge upon slanted surface 204 of the vertical section. Since the screw cannot move any direction but down, the continued threaded engagement causes the vertical section to flex inwardly as is desired, thus constricting the thumb opening 12. Reference is made to FIG. 3, wherein arrow X depicts the path of travel.

When the set screw 210 is loosened the inclined surface 204 will move back down toward its FIG. 1 position thereby relieving pressure upon the flexed vertical section 202, and causing it to return to its relaxed position per FIG. 1.

Optionally there may be included a cover layer 25 which is hingedly secured along the vertical axis of the inside of opening 12 at horizontal line 26, to ease the transition inward to a smooth feel thus avoiding the bump of the top surface 203 of the movable vertical section. This cover layer 25 is shown in cutaway in FIG. 3. It can comprise a thin layer of curved nylon or other self-supporting rigid plastic.

Typical dimensions include an elevation of about 2 and 23/32nds for the cylinder 15, with the conical base being of an elevation of about ⅜ths inches high.

We turn now to the second embodiment of the instant invention. It too uses a screw actuated member to flex a movable member's vertical section inwardly to thereby constrict the thumb opening. Again an optional cover to ease the transition over the ridge causes by the movement away from the vertical axis of the movable member may be employed. Here however, the set screw acts as a cam rotator to orient a cam lobe inwardly to impinge against the section capable of being flexed.

In this embodiment where possible, like numbers will refer to like parts, but the numbering system has been advanced by 100 such that the bowling ball designated 11 in the first embodiment is 111 here and a threaded bore formerly 209 will be designated as 309.

Figure 8:
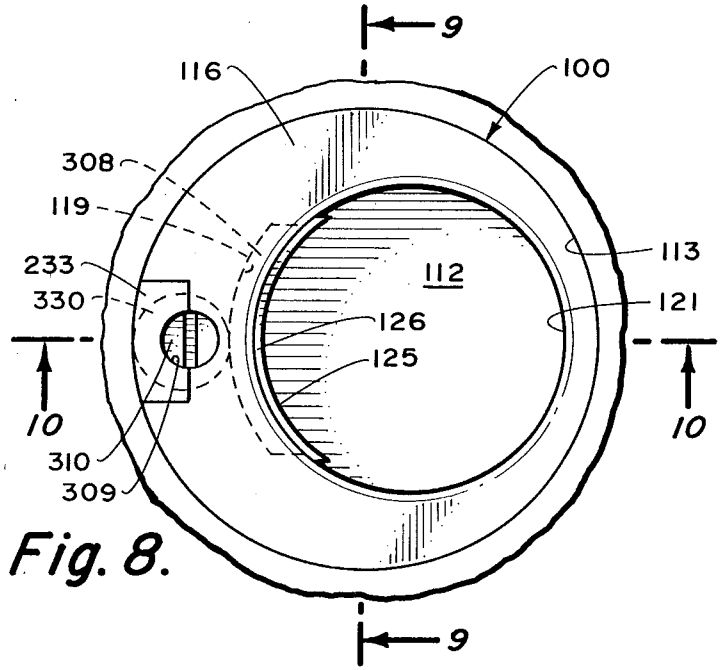
FIG. 8 is a top plan view of the second embodiment of this invention.
Figure 9:
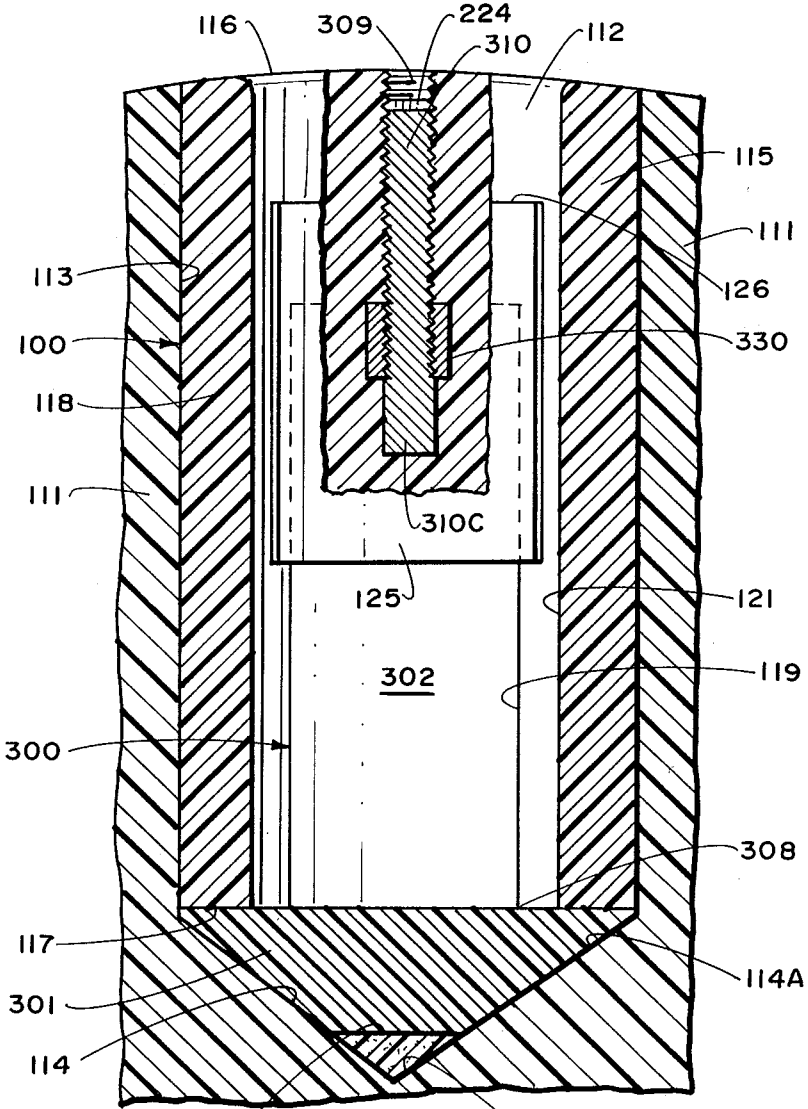
FIG. 9 is a sectional view taken along line 9—9 of FIG. 8.

Thus turning first to FIGS. 9 and 8 in that order, we see that device 100 constitutes two main sections, an outer cylinder 115, and movable member 300.

The outer cylinder 115 includes a circumscribing wall of varying thickness 118, which variances can be seen in FIG. 8. The thickness varies to allow adequate room for the movement means to be stored therein, and due to the necessity to maintain the same relative finger location. The top wall of the cylinder is designated 116, and the thumb opening therein 112 is not be confused with the thumb hole 113 into which the entire device 100 is to be disposed.

Speaking momentarily on the thumb hole 113, it is recognized again that the original hole may need widening, or replacement, again depending upon the desire if any to maintain the same finger span. It will in most instances need deepening. Whether original hole alteration or a new drilling is called for, a standard drill bit that tapers to a point should be used of proper diameter such that when adhesive is applied to the outer cylinder 115, a tight fit will be obtained on placement into the thumb hole 113.

Hole 113 is seen to communicate with hole 114, formed from the tip of the drill. Since the movable member 300's base section 301 is truncated, the portion of the hole designated 114B is filled in with a suitable plastic filler such as epoxy resin and allowed to harden. The portion of the hole 114A is seen to be adapted in size to receive said base 301. Base 301 is a truncated cone having an upper diameter larger than the bottom diameter, just as in the first embodiment, said first diameter being substantially equal to the diameter of the of the outer cylinder 115.

Depending downwardly from the top surface 116 is a bore 309 comprised of two communicating axially aligned bore segments and an optional third contiguous bore segment. These are designated 309A,B, and C respectively. The first segment 309A is a threaded zone adapted to receive the threads of the cam rotator 310, this last seen best in FIGS. 9 and 11. The middle segment is of a greater horizontal cross section and is adapted to receive the cam lobe 330, per FIGS. 11 and 12.

The third is a non-threaded zone adapted to receive the optional stabilizing boss 310C of the cam rotator 310. when such is employed. The diameter of this last zone for ease of operation should be the same as the threaded top zone 309A.

Figure 12:
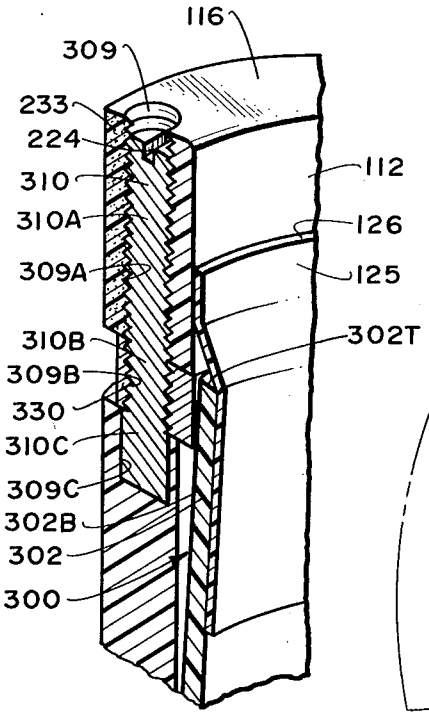
FIG. 12 is a perspective view of a portion of the invention and illustrating the mode of operation of this embodiment.
Figure 11:
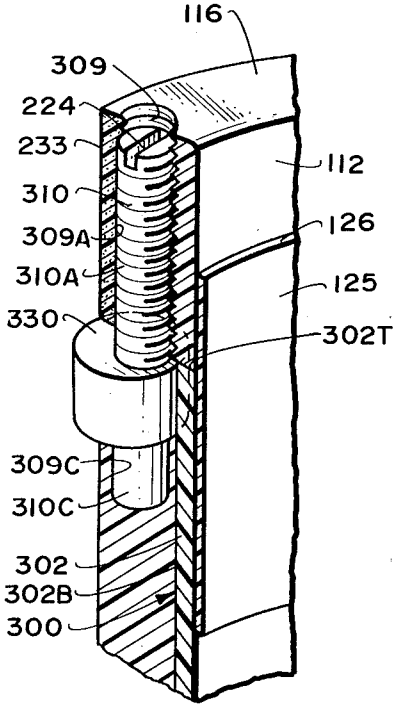
FIG. 11 is a perspective view of a portion of this embodiment.

Spaced down from the top 116 of the cylinder is an arcuate in the horizontal direction elongated recess 119 sized and adapted to receive the movable member's vertical section 302. Bore segment 309B is seen to communicate inwardly to said hollow recess whereby the cam lobe when in place can impinge upon the vertical section to move same. Reference is also made to FIGS. 11 and 12.

Figure 10:
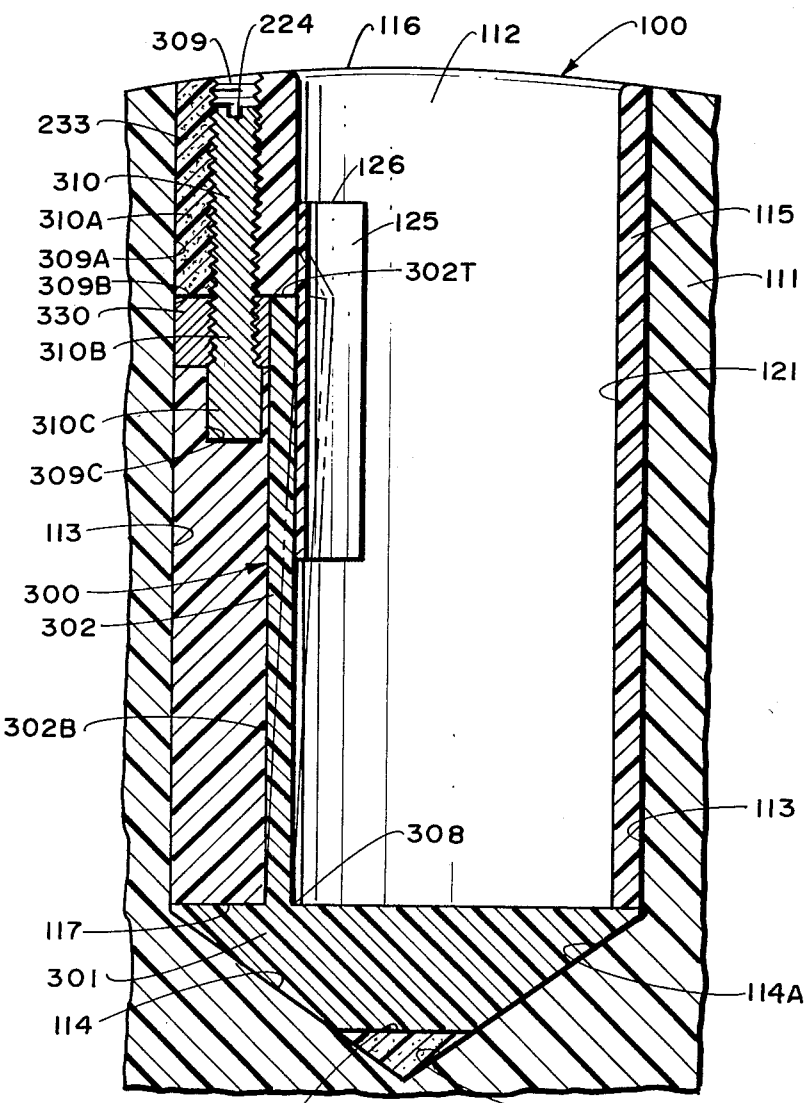
FIG. 10 is a perspective view taken along the line 10—10 of FIG. 8 with areas added for emphasis.

The cam rotator 310 best seen in FIG. 11, has its several parts designated in FIG. 12. These include a top threaded portion 310A, a middle unthreaded portion 310B to which is attached the cam lobe 330 (FIG. 11) and the optional stabilizing portion 310C. For ease of construction all of these should be formed as a single cast metal or plastic part. As can be seen from the drawings, the cam lobe 330 is a horizontally disposed eccentric member which when oriented at its minimum point of contact with the vertical section 302, permits the vertical member to remain vertical disposed within the recess 119 per FIG. 10. When however the slot 224 is driven by a screw driver or other suitable tool to clockwise rotate the cam rotator 310 from its first at rest position to any of the multiplicity of possible third positions wherein it impinges upon the back wall 302B of 302, it moves the vertical section 302 inwardly away from the recess as is shown in FIG. 12 whereby it assumes a slanted position relative to the point or line of attachment 308 (FIGS. 8 & 10).

The reader's attention is turned to the fact that whereas in the first embodiment, the long bore ran the full elevation of the device 10, here it is not necessary to do so, since the cam rotator is inserted from the top and not from the bottom. Once inserted, a plug 233 of suitable plastic is adhesed in place. This plug includes a portion of the threads (unnumbered) as shown in FIGS. 8, 10 and 12. For ease of understanding and lack of clutter, these feature was purposely omitted in FIG. 11.

Turning back to FIG. 9, there is shown the movable member 300 which comprises the base 301 which as mentioned previously is an inverted truncated cone sized at its upper (larger) diameter to be substantially equal to the diameter of the outer cylinder 115, such that it can be adhesed to the underside of said open cylinder to close same. The vertical section of said movable member is designated 302. In FIG. 9 it is shown in cutaway, joined at line 308 to said base 301. It is shown in cutaway to illustrate how it is sized to fit into recess 119. It, the vertical sections's true shape is depicted in FIG. 10.

The operation of the instant embodiment is similar to that of the first embodiment in that the movable section flexes inwardly upon rotation of the screw slot 224. The vertical section 302 of the movable member 300 will flex from the first position illustrated in FIGS. 8 & 10, generally vertical, to any of a plurality of second positions, slightly canted, as illustrated in FIG. 12, the amount of flex being limited by the maximum rotation of the cam lobe 330. Since the top surface 302T has a finite thickness, it is seen again that a "step" is formed relative to the vertical wall of the thumb opening 112. To eliminate this ridge, an adhesively secured cover layer is adhesed along its top edge inside the thumb opening 112 to ease the transition and form a smooth downwardly constricting thumb opening. This cover 125 is shown cutaway on each vertical side for ease of understanding of its placement relative to the vertical section. In life size however, it is at least as wide as the vertical section 302 that it covers up. Typically nylon sheet is used for covers 25 and 125. Suitable adhesives for securing same are readily available in the marketplace.

Figure 13:
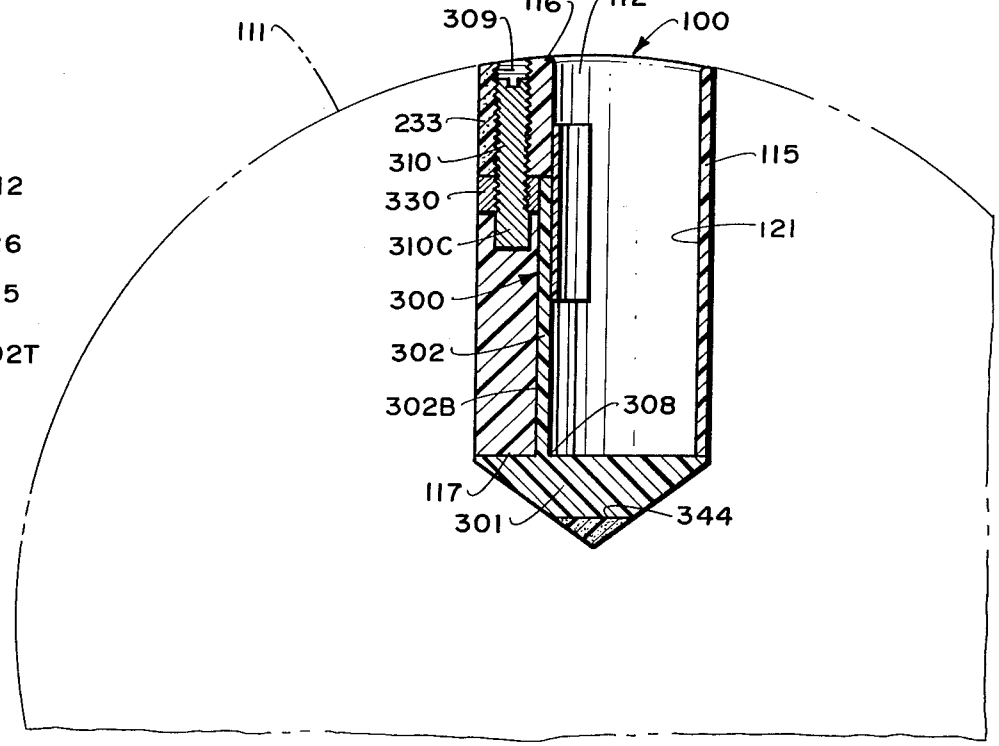
FIG. 13 is a view similar to FIG. 6 in that it shows the placement of the second embodiment of the device within the bowling ball.

FIG. 13 is similar to FIG. 6 in that it shows the device of the second embodiment disposed within the ball.

Figure 7:
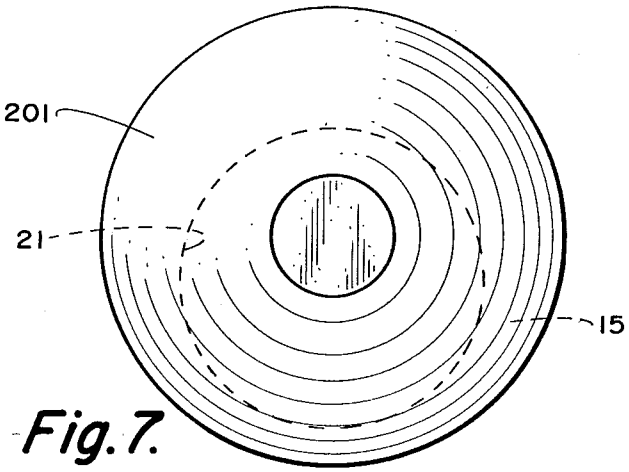
FIG. 7 is a bottom plan view of the embodiment of FIG. 1.

The underside of the second embodiment is seen to be the same as the first embodiment, and by reference to FIG. 7 with a mental change of the parts numbers to 115 and 301 respectively the under view can be appreciated.

While the device in both embodiments of this invention may be employed in any of the finger holes, it is anticipated that the primary utilization thereof will be in the thumb hole. This is because it is desired to maintain the span of the fingers and because the thumb is the most susceptible to calluses, sweat and friction and because the thumb carries most of the weight of the ball. Thus, the word finger will be used for the purpose of claiming the device, though the thumb is primarily intended.

It is seen that the adjustable inserts of this invention both comply with the requirements of the American Bowling Congress., in that they are both recessed flush with the top of the bowling ball; no parts can come loose to scratch lanes, such as screws; and no metal parts are utilized.

Materials suitable for the balance of the instant device include ABS and other moldable plastics.

Since certain changes may be made in the above article without departing from the scope of the invention herein involved, it is intended that all matter contained in the above description and shown in the accompanying drawings shall be interpreted as illustrative and not in a limiting sense.

I claim:

1. An adjustable diameter finger receiving device for insertion into a bowling bowl finger opening which comprises:

a cylindrical member having both and inner and outer diameters, the outer diameter of said cylinder being sized such a that the cylindrical member will fit snugly into a finger hole of the bowling ball;

the cylinder having a top and bottom wall, and an eccentrically disposed vertical finger opening there through, said cylindrical member being closed off at its bottom end by a base comprising a downwardly decreasing truncated cone, an arcuate recess extending upwardly from the bottom of the cylinder and inwardly from the proximal side of said finger opening, terminating at a point below the top of said cylindrical member, a bore extending downwardly from the top of said cylinder adjacent said vertical finger opening, and extending downwardly past at least a part of said recess, and communicating with said recess;

a bottom mounted flexible vertical arcuate section affixed to the upper surface of said base and sized to fit within said recess, means disposed within said bore operably adapted to move the top of said vertical arcuate section inwardly from a first position within said recess to a second position out of said recess, thereby constricting the diameter of said finger opening.

2. In the device of claim 1 wherein the downwardly extending bore is threaded from the top of the cylinder to about the top of the recess, and extends unthreaded through the rest of the cylinder, and the means disposed within said bore is a set screw having a bottom shoulder to prevent the screw from being upwardly unthreaded.

3. In the device of claim 2 wherein a caming member is mounted on the rear side of said vertical arcuate section, said caming member being impingeable against by the shoulder of said set screw, whereby movement of the set screw causes movement of the vertical section.

4. In the device of claim 1 wherein the downwardly extending bore comprises two communicating axially aligned bore segments, the first being a threaded zone adapted to receive the threads of a cam rotator, and the second zone is of greater horizontal cross section and constitutes the portion of the bore that communicates with said recess, a cam rotator having a top threaded portion and an unthreaded portion to which is attached a cam lobe, said cam lobe being impingeable upon rotation upon said vertical arcuate section whereby movement of the threaded portion of the cam rotator causes movement of the vertical section.

5. In the device of claim 1 wherein the entire device is made of plastic.

6. In the device of claim 1 further including an arcuate cover flexibly mounted within said finger opening above said recess, said cover depending downwardly and overlaying said vertical section and adapted to ease the transition from the wall of said finger opening to said front of said vertical section by the bowler's finger, whereby movement of said vertical section moves said cover.

* * * * *